US011193699B2

(12) United States Patent
Sun et al.

(10) Patent No.: US 11,193,699 B2
(45) Date of Patent: Dec. 7, 2021

(54) COOLING SYSTEM

(71) Applicant: Heatcraft Refrigeration Products LLC, Stone Mountain, GA (US)

(72) Inventors: Xi Sun, Snellville, GA (US); Shitong Zha, Snellville, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 518 days.

(21) Appl. No.: 16/174,576

(22) Filed: Oct. 30, 2018

(65) Prior Publication Data

US 2020/0132345 A1 Apr. 30, 2020

(51) Int. Cl.
*F25B 31/00* (2006.01)
*F25B 5/02* (2006.01)

(52) U.S. Cl.
CPC ..... *F25B 31/004* (2013.01); *F25B 5/02* (2013.01); *F25B 2341/0016* (2013.01); *F25B 2400/23* (2013.01)

(58) Field of Classification Search
CPC ..... F25B 31/00; F25B 31/002; F25B 31/004; F25B 2341/0013; F25B 2400/0407; F25B 5/02
See application file for complete search history.

(56) References Cited

U.S. PATENT DOCUMENTS 3,500,962 A * 3/1970 Kocher ..... F04B 41/06 184/103.1
10,801,757 B2 * 10/2020 Hellmann ..... F25B 5/02

FOREIGN PATENT DOCUMENTS

CN 2005/10026386.4 10/2005
EP 3 372 920 A1 9/2018
WO WO 2016/004988 A1 1/2016

OTHER PUBLICATIONS

Extended European Search Report from EPO Patent Office, Application No. 19202784.5-1008; Ref: DHP103289P.EPP.; 8 pages, dated Jan. 14, 2020.

* cited by examiner

*Primary Examiner* — Jianying C Atkisson
*Assistant Examiner* — Erik Mendoza-Wilkenfel
(74) *Attorney, Agent, or Firm* — Baker Botts L.L.P.

(57) ABSTRACT

An apparatus includes a high side heat exchanger, a flash tank, a first load, a first oil separator, and a first compressor. The high side heat exchanger removes heat from a refrigerant. The flash tank stores the refrigerant. The first load uses the refrigerant to cool a first space proximate the first load. During a first mode of operation, the first oil separator separates an oil from the refrigerant from the first load and directs the refrigerant to an ejector. The ejector directs the refrigerant from the high side heat exchanger and the refrigerant form the first oil separator to the flash tank. The flash tank directs the refrigerant from the first oil separator to the first compressor. The first compressor compresses the refrigerant from the flash tank. During a second mode of operation, the first oil separator directs the oil separated from the refrigerant to the first compressor.

20 Claims, 4 Drawing Sheets

COOLING SYSTEM

TECHNICAL FIELD

This disclosure relates generally to a cooling system.

BACKGROUND

Cooling systems may cycle a refrigerant to cool various spaces. For example, a refrigeration system may cycle refrigerant to cool spaces near or around refrigeration loads. After the refrigerant absorbs heat, it can be cycled back to the refrigeration loads to defrost the refrigeration loads.

SUMMARY

Cooling systems cycle refrigerant to cool various spaces. In some systems, vapor ejection is performed to boost efficiency. In these systems, a refrigerant is mixed with a gaseous form of the refrigerant in an ejector before the mixture is sent to a flash tank. In this manner, the efficiency of the system is improved. In these systems, one or more of the loads uses the refrigerant from the flash tank to cool a space, and then these loads direct some of the refrigerant back to the flash tank and some of the refrigerant to a compressor. However, a detrimental oil cycle forms when all the refrigerant from the load is directed to the flash tank.

In existing cooling systems, oil is used cool and/or lubricate a compressor. As the compressor runs, the oil may mix with the refrigerant in the compressor and, as a result, the refrigerant may carry the oil to other parts of the system. Typically, a component called an oil separator is used to separate the oil from the refrigerant so that the oil can be returned to the compressor. In a vapor ejection system, when all the refrigerant from a load is directed to the flash tank, the oil in the refrigerant begins to cycle in the system without reaching the compressor or the oil separator. As a result, this oil is not separated and begins to build in the system. Oil buildup may cause other components of the cooling system to degrade or fail.

This disclosure contemplates an unconventional cooling system that restrains the formation of oil cycles. The system includes an additional oil separator in the region of the cooling system where an oil cycle could form. That oil separator separates oil from the refrigerant and directs the oil to the compressor. In this manner, an oil cycle does not form because the oil is separated from the refrigerant in the region of the system where an oil cycle could form. Certain embodiments are described below.

According to one embodiment, an apparatus includes a high side heat exchanger, a flash tank, a first load, a first oil separator, and a first compressor. The high side heat exchanger removes heat from a refrigerant. The flash tank stores the refrigerant from the high side heat exchanger. The first load uses the refrigerant from the flash tank to cool a first space proximate the first load. During a first mode of operation, the first oil separator separates an oil from the refrigerant from the first load and directs the refrigerant to an ejector. The ejector directs the refrigerant from the high side heat exchanger and the refrigerant form the first oil separator to the flash tank. The flash tank directs the refrigerant from the first oil separator to the first compressor. The first compressor compresses the refrigerant from the flash tank. During a second mode of operation, the first oil separator directs the oil separated from the refrigerant to the first compressor.

According to another embodiment, a method includes removing, by a high side heat exchanger, heat from a refrigerant and storing, by a flash tank, the refrigerant from the high side heat exchanger. The method also includes using, by a first load, the refrigerant from the flash tank to cool a first space proximate the first load. During a first mode of operation, the method includes separating, by an oil separator, an oil from the refrigerant from the first load and directing, by the oil separator, the refrigerant to an ejector. The method also includes directing, by the ejector, the refrigerant from the high side heat exchanger and the refrigerant form the first oil separator to the flash tank, directing, by the flash tank, the refrigerant from the first oil separator to the first compressor, and compressing, by the first compressor, the refrigerant from the flash tank. During a second mode of operation, the method includes directing, by the first oil separator, the oil separated from the refrigerant to the first compressor.

According to yet another embodiment, a system includes a high side heat exchanger, a flash tank, a first load, a second load, a first oil separator, a first compressor, and a second compressor. The high side heat exchanger removes heat from a refrigerant. The flash tank stores the refrigerant from the high side heat exchanger. The first load uses the refrigerant from the flash tank to cool a first space proximate the first load. The second load uses the refrigerant from the flash tank to cool a second space proximate the second load. The second compressor compresses the refrigerant from the second load. During a first mode of operation, the first oil separator separates an oil from the refrigerant from the first load and directs the refrigerant to an ejector. The ejector directs the refrigerant from the high side heat exchanger and the refrigerant form the first oil separator to the flash tank. The flash tank directs the refrigerant from the first oil separator to the first compressor. The first compressor compresses the refrigerant from the flash tank and the refrigerant from the second compressor. During a second mode of operation, the first oil separator directs the oil separated from the refrigerant to the first compressor.

Certain embodiments may provide one or more technical advantages. For example, an embodiment prevents an oil cycle from forming in a cooling system. As another example, an embodiment improves the durability and lifespan of components in a cooling system by separating oil from a refrigerant. As yet another example, an embodiment returns oil from a low pressure side of a cooling system to a high pressure side of the cooling system. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Embodiments of the present disclosure and its advantages are best understood by referring to FIGS. 1 through 4 of the drawings, like numerals being used for like and corresponding parts of the various drawings.

Cooling systems cycle refrigerant to cool various spaces. In some systems, vapor ejection is performed to boost efficiency. In these systems, a refrigerant is mixed with a gaseous form of the refrigerant in an ejector before the mixture is sent to a flash tank. In this manner, the efficiency of the system is improved. In these systems, one or more of the loads uses the refrigerant from the flash tank to cool a space, and then these loads direct some of the refrigerant back to the flash tank and some of the refrigerant to a compressor. However, a detrimental oil cycle forms when all the refrigerant from the load is directed to the flash tank.

In existing cooling systems, oil is used cool and/or lubricate a compressor. As the compressor runs, the oil may mix with the refrigerant in the compressor and, as a result, the refrigerant may carry the oil to other parts of the system. Typically, a component called an oil separator is used to separate the oil from the refrigerant so that the oil can be returned to the compressor. In a vapor ejection system, when the pressure is too low, the oil in the refrigerant begins to cycle in the system without reaching the compressor or the oil separator. As a result, this oil is not separated and begins to build in the system. Oil buildup may cause other components of the cooling system to degrade or fail.

Figure 1:
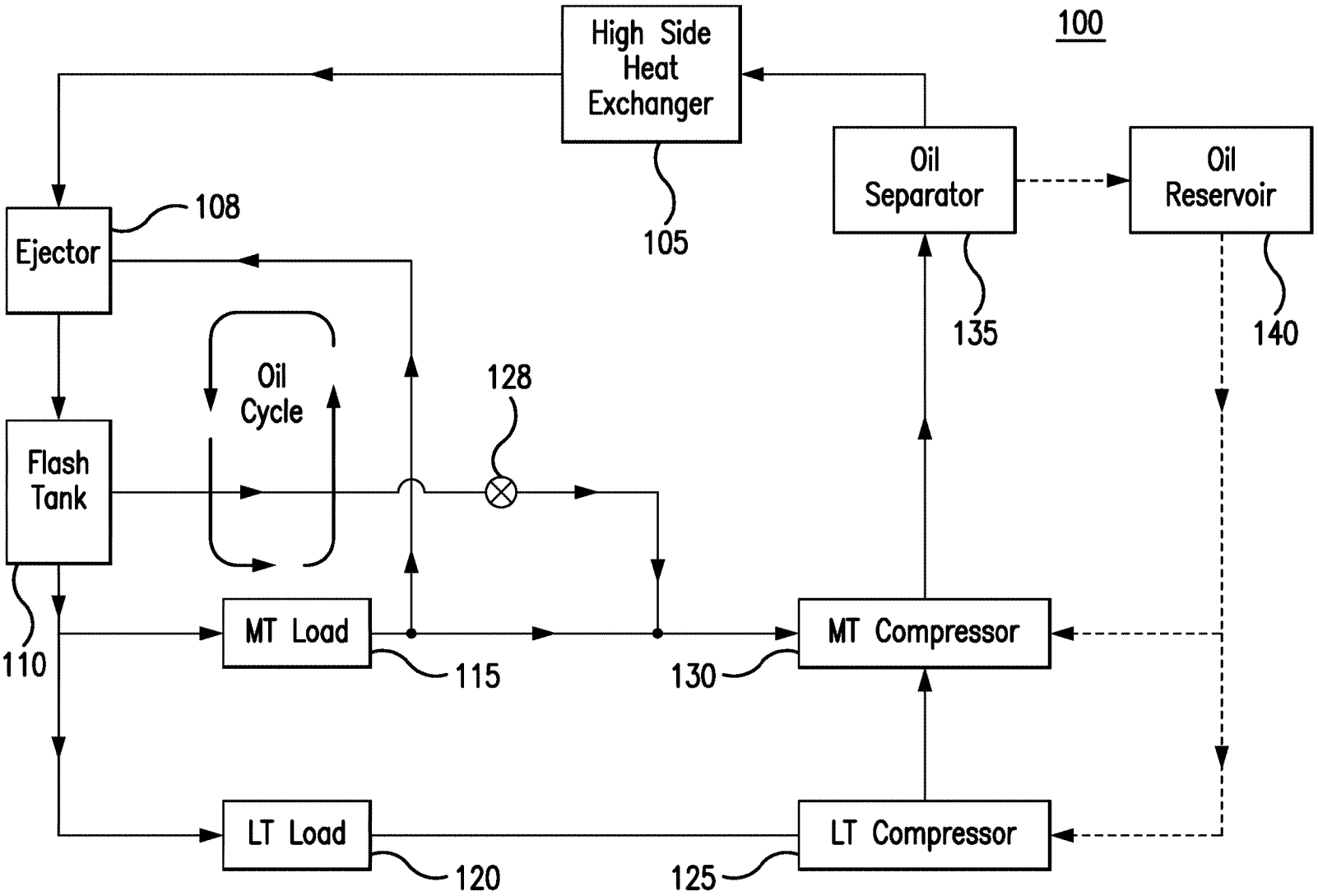
FIG. 1 illustrates an example cooling system.
Figure 2:
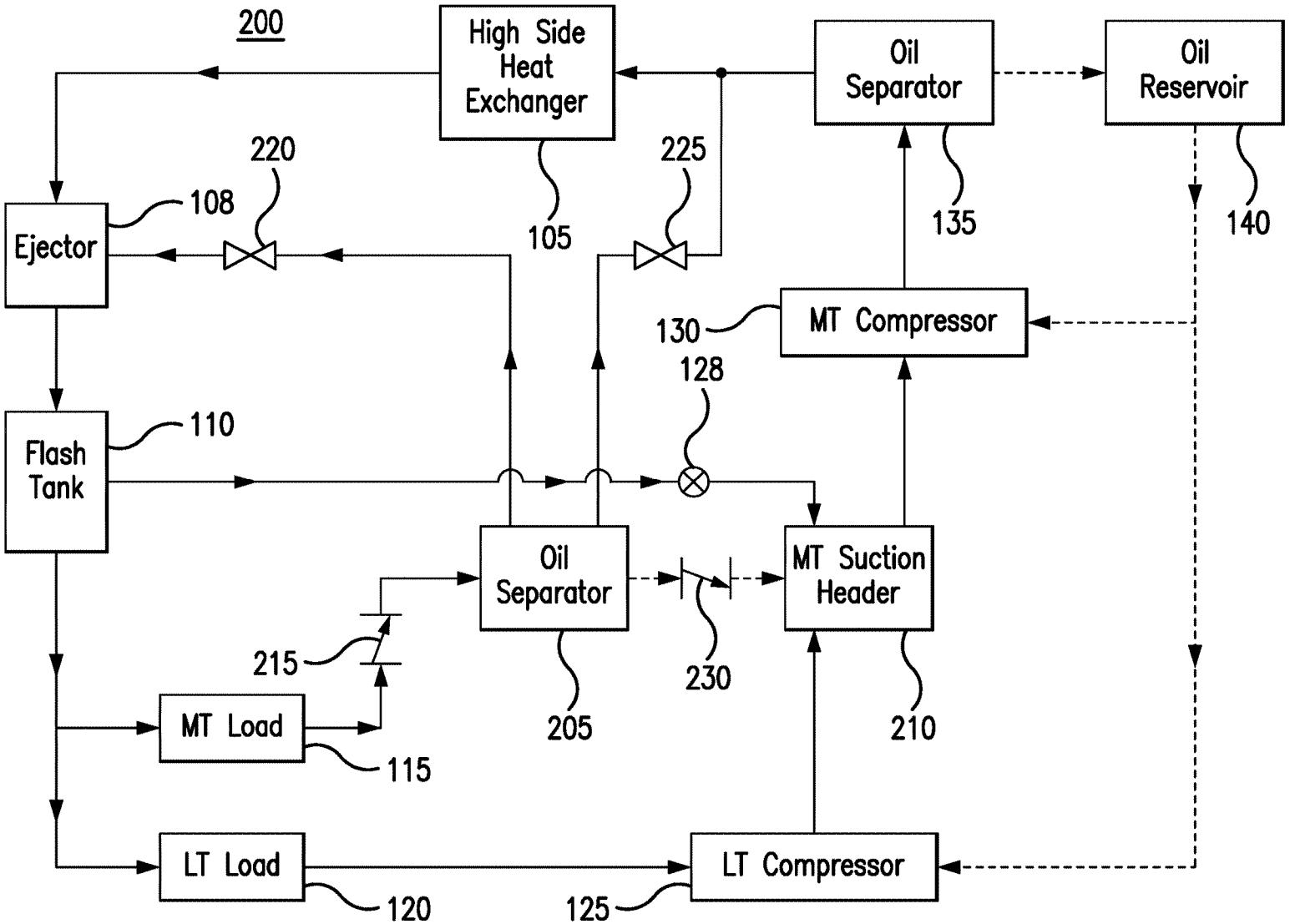
FIG. 2 illustrates an example cooling system.
Figure 3:
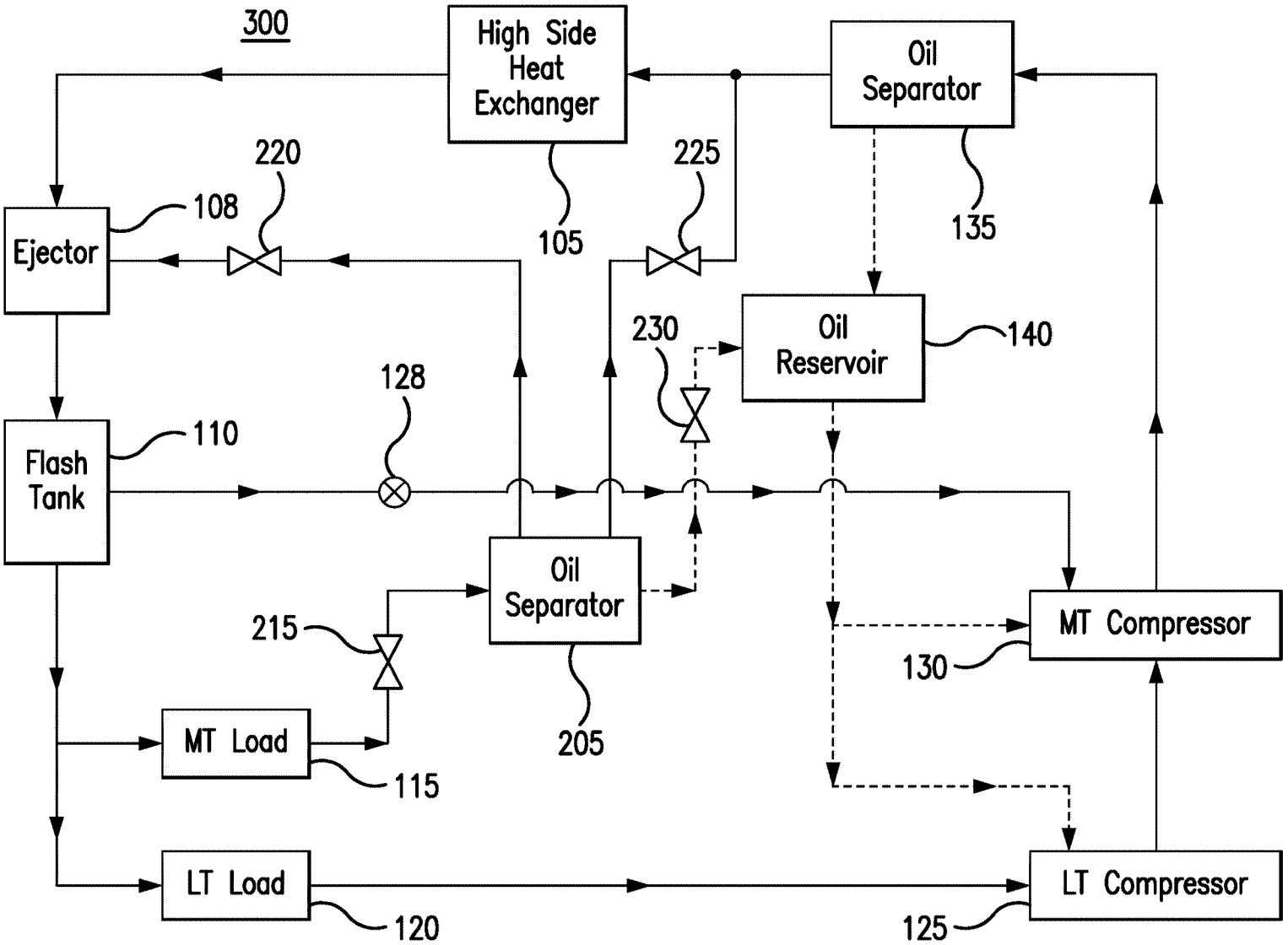
FIG. 3 illustrates an example cooling system.
Figure 4:
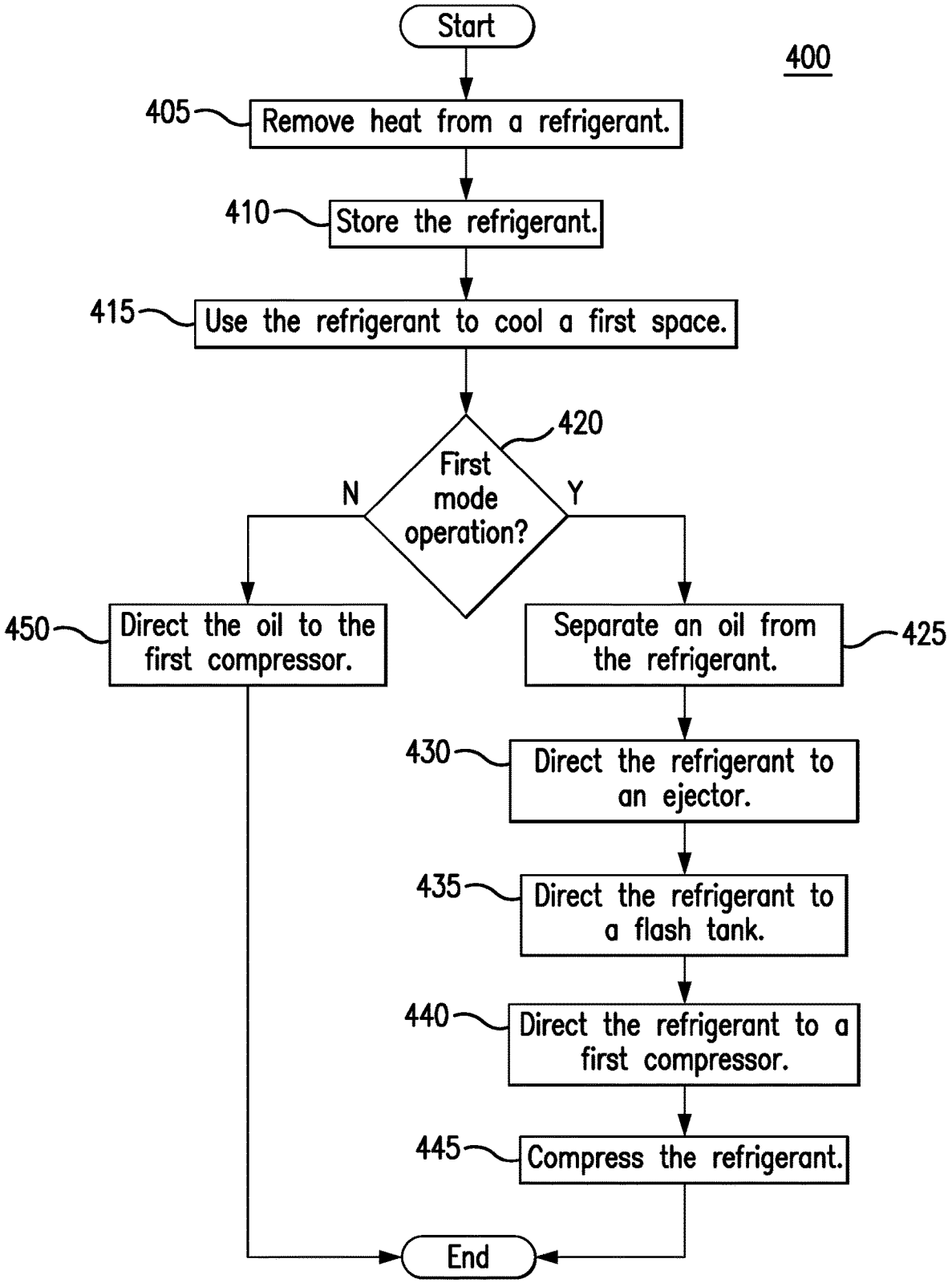
FIG. 4 is a flowchart illustrating a method of operating the example cooling systems of FIGS. 2 and 3.

This disclosure contemplates an unconventional cooling system that restrains the formation of oil cycles. The system includes an additional oil separator in the region of the cooling system where an oil cycle could form. That oil separator separates oil from the refrigerant and directs the oil to the compressor. In this manner, an oil cycle does not form because the oil is separated from the refrigerant in the region of the system where an oil cycle could form. Certain embodiments are described below. The cooling system will be described using FIGS. 1 through 4. FIG. 1 will describe an existing cooling system with an oil cycle. FIGS. 2-4 describe the cooling system that restrains the formation of oil cycles.

FIG. 1 illustrates an example cooling system 100. As shown in FIG. 1, system 100 includes a high side heat exchanger 105, an ejector 108, a flash tank 110, a medium temperature load 115, a low temperature load 120, a low temperature compressor 125, a medium temperature compressor 130, a valve 128, an oil separator 135, and an oil reservoir 140. Generally, system 100 performs vapor ejection on a refrigerant through ejector 108. For example, ejector 108 directs a mixture of refrigerant from high side heat exchanger 105 and refrigerant from medium temperature load 115 to flash tank 110. By performing vapor ejection, the efficiency of system 100 is improved.

High side heat exchanger 105 removes heat from a refrigerant. When heat is removed from the refrigerant, the refrigerant is cooled. This disclosure contemplates high side heat exchanger 105 being operated as a condenser and/or a gas cooler. When operating as a condenser, high side heat exchanger 105 cools the refrigerant such that the state of the refrigerant changes from a gas to a liquid. When operating as a gas cooler, high side heat exchanger 105 cools gaseous refrigerant and the refrigerant remains a gas. In certain configurations, high side heat exchanger 105 is positioned such that heat removed from the refrigerant may be discharged into the air. For example, high side heat exchanger 105 may be positioned on a rooftop so that heat removed from the refrigerant may be discharged into the air. As another example, high side heat exchanger 105 may be positioned external to a building and/or on the side of a building.

Ejector 108 receives refrigerant from high side heat exchanger 105 and medium temperature load 115. Ejector 108 then ejects and/or directs this refrigerant to flash tank 110. In some systems, the pressure of the ejected refrigerant is controlled and/or adjusted by the pressure of the refrigerant from medium temperature load 115 and the shape of ejector 108. In this manner, the efficiency of system 100 is improved.

Flash tank 110 stores refrigerant received from high side heat exchanger 105 and/or ejector 108. This disclosure contemplates flash tank 110 storing refrigerant in any state such as, for example, a liquid state and/or a gaseous state. Refrigerant leaving flash tank 110 is fed to low temperature load 120 and medium temperature load 115. In some embodiments, a flash gas and/or a gaseous refrigerant (e.g., from medium temperature load 115) is released from flash tank 110 through valve 128 to medium temperature compressor 130. By releasing flash gas, the pressure within flash tank 110 may be reduced.

System 100 includes a low temperature portion and a medium temperature portion. The low temperature portion operates at a lower temperature than the medium temperature portion. In some refrigeration systems, the low temperature portion may be a freezer system and the medium temperature system may be a regular refrigeration system. In a grocery store setting, the low temperature portion may include freezers used to hold frozen foods, and the medium temperature portion may include refrigerated shelves used to hold produce. Refrigerant flows from flash tank 110 to both the low temperature and medium temperature portions of the refrigeration system. For example, the refrigerant flows to low temperature load 120 and medium temperature load 115. When the refrigerant reaches low temperature load 120 or medium temperature load 115, the refrigerant removes heat from the air around low temperature load 120 or medium temperature load 115. As a result, the air is cooled. The cooled air may then be circulated such as, for example, by a fan to cool a space such as, for example, a freezer and/or a refrigerated shelf. As refrigerant passes through low temperature load 120 and medium temperature load 115 the refrigerant may change from a liquid state to a gaseous state as it absorbs heat. This disclosure contemplates system 100 including any number of loads.

Medium temperature load 115 directs some refrigerant to ejector 108. The refrigerant may be in vapor or gaseous form. Ejector 108 mixes the refrigerant from medium temperature load 115 with the refrigerant from high side heat exchanger 105 and directs the mixture to flash tank 110.

Refrigerant flows from low temperature load 120, medium temperature load 115, and flash tank 110 to compressors 125 and 130. This disclosure contemplates system 100 including any number of low temperature compressors 125 and medium temperature compressors 130. Both the low temperature compressor 125 and medium temperature compressor 10 compress refrigerant to increase the pressure of the refrigerant. As a result, the heat in the refrigerant may become concentrated and the refrigerant may become a high-pressure gas. Low temperature compressor 125 compresses refrigerant from low temperature load 120 and sends the compressed refrigerant to medium temperature compressor 130. Medium temperature compressor 10 compresses a mixture of the refrigerant from low temperature compressor 125, medium temperature load 115, and flash tank 110. The refrigerant from flash tank 110 may include the refrigerant from medium temperature load 115. Medium temperature compressor 130 then sends the compressed refrigerant to oil separator 135.

Flash tank 110 discharges gaseous refrigerant through valve 128 to medium temperature compressor 130. For example, flash tank 110 may discharge a flash gas and the refrigerant from medium temperature load 115 to medium temperature compressor 130 through valve 128. Valve 128 controls the flow of flash gas and refrigerant from flash tank 110 to medium temperature compressor 130. For example, valve 128 may be opened more to increase the flow of flash gas and refrigerant through valve 128. As another example, valve 128 may be closed more to decrease the flow of flash gas and refrigerant through valve 128.

In existing cooling systems, oil is used cool and/or lubricate compressor 125 or 130. As the compressor runs, the oil may mix with the refrigerant in the compressor and, as a result, the refrigerant may carry the oil to other parts of the system. Typically, a component called an oil separator is used to separate the oil from the refrigerant so that the oil can be returned to the compressor. Oil separator 135 receives refrigerant from medium temperature compressor 130 and separates an oil from that refrigerant. Oil separator 135 then directs the refrigerant to high side heat exchanger 105 and the oil to oil reservoir 140. Oil reservoir 140 collects the oil separated from the refrigerant by oil separator 135. Oil reservoir 140 directs the oil back to low temperature compressor 125 and medium temperature compressor 130. In this manner, oil is re-added to low temperature compressor 125 and medium temperature compressor 130.

Typically, a portion of the refrigerant flows from medium temperature load 115 directly to medium temperature compressor 130. In some instances, because of particular pressure differentials in system 100, refrigerant from medium temperature load 115 is completely directed to ejector 108 instead of to medium temperature compressor 130. As a result, the oil in the refrigerant begins to cycle between ejector 108, flash tank 110, and medium temperature load 115 and forms an oil cycle. In other words, the oil does not get sent back to medium temperature compressor 130 and instead cycles in those three other components. As system 100 continues to run, oil begins to accumulate in ejector 108, flash tank 110, and medium temperature load 115, which degrades their performance and may cause them to fail.

This disclosure contemplates various configurations of a cooling system that restrain the oil cycle from forming in the cooling system. As a result, the oil can be returned to the compressors instead of accumulating in other components of the cooling system which improves the durability, lifespan, and efficiency of the components of the cooling system in certain embodiments. These cooling systems will be described in more detail using FIGS. 2 through 4.

FIG. 2 illustrates an example cooling system 200. As shown in FIG. 2, cooling system 200 includes a high side heat exchanger 105, an ejector 108, a flash tank 110, a medium temperature load 115, a low temperature load 120, a low temperature compressor 125, a valve 128, a medium temperature compressor 130, an oil separator 135, an oil reservoir 140, an oil separator 205, a medium temperature suction header 210, a valve 215, a valve 220, a valve 225, and a valve 230. Generally, system 200 uses an oil separator 205 to separate oil from the refrigerant from medium temperature load 115 so that the oil does not cycle within ejector 108, flash tank 110, and medium temperature load 115. As a result, the efficiency, durability, and lifespan of ejector 108, flash tank 110, and medium temperature load 115 is improved in certain embodiments.

High side heat exchanger 105, ejector 108, flash tank 110, medium temperature load 115, low temperature load 120, low temperature compressor 125, medium temperature compressor 130, oil separator 135 and oil reservoir 140 operate similarly as they did in system 100. For example, high side heat exchanger 105 removes heat from a refrigerant. Ejector 108 directs a mixture of refrigerant from medium temperature load 115 and high side heat exchanger 105 to flash tank 110. Flash tank 110 stores refrigerant. Medium temperature load 115 uses the refrigerant to cool a space proximate medium temperature load 115. Low temperature load 120 uses the refrigerant to cool a space proximate low temperature load 120. Low temperature compressor 125 compresses refrigerant from low temperature load 120. Medium temperature compressor 130 compresses refrigerant from low temperature compressor 125, medium temperature load 115, and/or flash tank 110. Oil separator 135 separates an oil from the refrigerant from medium temperature compressor 130. Oil separator 135 then directs the refrigerant to high side heat exchanger 105 and the oil to oil reservoir 140. Oil reservoir 140 collects the oil from oil separator 135 and returns the oil to medium temperature compressor 130 and low temperature compressor 125.

Oil separator 205 is positioned between medium temperature load 115 and ejector 108. Oil separator 205 separates an oil from the refrigerant from medium temperature load 115 before that refrigerant reaches ejector 108. Oil separator 205 then returns the collected oil to medium temperature suction header 210 where the oil is returned to medium temperature compressor 130. In this manner, oil is removed from the refrigerant from medium temperature load 115 so that the oil does not cycle within ejector 108, flash tank 110, and medium temperature load 115.

Oil separator 205 operates in two modes of operation. In the first mode of operation, oil separator 205 separates and collects oil from the refrigerant from medium temperature load 115. In the second mode of operation, oil separator 205 returns the collected oil to medium temperature suction header 210. Oil separator 205 alternates between these two modes of operation to separate and return oil. Generally, the second mode of operation is much shorter in duration than the first mode of operation.

During the first mode of operation, valve 220 is open and valve 225 is closed. Refrigerant from medium temperature load 115 travels through valve 215 to oil separator 205. Valve 215 may be any suitable valve, such as for example, a check valve or a solenoid valve. Oil separator 205 separates oil from the refrigerant from medium temperature load 115 and collects that oil. Oil separator 205 then directs the refrigerant through valve 220 to ejector 108. Ejector 108 then directs that refrigerant to flash tank 110. Flash tank 110 then discharges that refrigerant to medium temperature suction header 210 through valve 128.

During the second mode of operation, valve 220 is closed and valve 225 is open. As a result, oil separator 205 begins to pressurize to the pressure at an inlet of high side heat exchanger 105. This increase in pressure pushes the oil collected in oil separator 205 through valve 230 to medium temperature suction header 210. Valve 230 may be any suitable valve, such as for example, a check valve or a solenoid valve. In this manner, the oil collected by oil separator 205 is returned to medium temperature suction header 210 and medium temperature compressor 130. In certain embodiments, oil separator 205 may include a level sensor that detects a level of the collected oil in oil separator 205. When the detected level exceeds a threshold, oil separator 205 may transition from the first mode of operation to the second mode of operation to return the oil to medium temperature suction header 210 and medium temperature compressor 130. As a result, oil separator 205 does not fill up or overflow with oil.

Medium temperature suction header 210 receives the refrigerant and/or oil that is to be directed to medium temperature compressor 130. Medium temperature suction header 210 receives refrigerant from low temperature compressor 125 and flash tank 110. The refrigerant from flash tank 110 may be directed through valve 128. Medium temperature suction header 210 receives oil from oil separator 205 through valve 230. In particular embodiments, valve 230 prevents the oil from oil separator 205 from flowing back to oil separator 205 during the second mode of operation. Valve 230 may be any suitable valve such as a solenoid valve or a check valve.

Medium temperature compressor 130 receives the refrigerant and the oil in medium temperature suction header 210. Medium temperature compressor 130 compresses the refrigerant and oil received from medium temperature suction header 210 and directs the refrigerant and the oil to oil separator 135.

In particular embodiments, system 200 separates oil from the refrigerant from medium temperature load 115 so that the oil does not cycle back to ejector 108 and flash tank 110. As a result, oil is prevented from accumulating in ejector 108, flash tank 110, and medium temperature load 115 which improves their durability, efficiency, and life span.

FIG. 3 illustrates an example cooling system 300. Shown on FIG. 3, system 300 includes a high side heat exchanger 105, an ejector 108, a flash tank 110, a medium temperature load 115, a low temperature load 120, a low temperature compressor 125, a valve 128, a medium temperature compressor 130, an oil separator 135, an oil reservoir 140, an oil separator 205, a valve 215, a valve 220, a valve 225, and a valve 230. Generally, system 300 uses oil separator 205 to separate an oil from a refrigerant from medium temperature load 115. In this manner, oil does not cycle back to ejector 108, flash tank 110, and medium temperature load 115 in certain embodiments.

High side heat exchanger 105, ejector 108, flash tank 110, medium temperature load 115, low temperature load 120, low temperature compressor 125, valve 128, medium temperature compressor 130, oil separator 135, and oil reservoir 140 behave similarly as they did in system 100. For example, high side heat exchanger 105 removes heat from a refrigerant. Ejector 108 directs a mixture of refrigerant from high side heat exchanger 105 and medium temperature load 115 to flash tank 110. Flash tank 110 stores refrigerant. Medium temperature load 115 uses refrigerant to cool a space proximate medium temperature load 115. Low temperature load 120 uses refrigerant to cool a space proximate low temperature load 120. Low temperature compressor 125 compresses refrigerant from low temperature load 120. Medium temperature compressor 130 compresses a refrigerant from flash tank 110 and from low temperature compressor 125. Oil separator 135 separates an oil from the refrigerant from medium temperature compressor 130. Oil reservoir 140 collects the oil separated by oil separator 135 and returns the oil to low temperature compressor 125 and medium temperature compressor 130.

Oil separator 205 behaves similarly as it did in system 200. Oil separator 205 receives a refrigerant from medium temperature load 115 and separates an oil from that refrigerant. Oil separator 205 then directs the refrigerant to ejector 208. An important difference between system 300 and system 200 is that oil separator 205 directs collected oil to oil reservoir 140 instead of to a medium temperature suction header and/or medium temperature compressor 130. Oil separator 205 still has two modes of operation.

During the first mode of operation, oil separator 205 separates and collects oil from a refrigerant from medium temperature load 115. During the first mode of operation, valve 220 is open and valve 225 is closed. Refrigerant from medium temperature load 115 flows to oil separator 205 through valve 215. Valve 215 may be any suitable valve, such as a solenoid valve or a check valve. Oil separator 205 separates oil from the refrigerant from medium temperature load 115 and directs the refrigerant to ejector 108 through valve 220. Ejector 108 directs the refrigerant to flash tank 110. Flash tank 110 then directs the refrigerant through valve 128 to medium temperature compressor 130. Oil separator 205 collects the separated oil. In particular embodiments, oil separator 205 includes a level sensor that detects the level of oil collected in oil separator 205. When the level of oil exceeds a threshold, oil separator 205 and system 300 may transition from the first mode of operation to the second mode of operation.

During the second mode of operation, valve 220 closes and valve 225 opens. As a result, oil separator 205 begins to pressurize to the pressure at an inlet of high side heat exchanger 105. The increased pressure pushes the oil collected in oil separator 205 through valve 230 to oil reservoir 140. Valve 230 may be any suitable valve such as, for example, a solenoid valve or a check valve. Oil reservoir 140 collects the oil and returns the oil to low temperature compressor 125 and medium temperature compressor 130. In particular embodiments, the second mode of operation is much shorter in duration than the first mode of operation.

FIG. 4 is a flow chart illustrating a method 400 of operating the example cooling systems 200 and 300 of FIGS. 2 and 3. In particular embodiments, various components of systems 200 and 300 perform the steps of method 400. By performing method 400, a cooling system prevents oil from cycling within the system, thus improving the lifespan, durability, and efficiency of certain components within the system in particular embodiments.

Method 400 begins when a high side heat exchanger removes heat from a refrigerant in step 405. In step 410, a flash tank stores the refrigerant. A first load, such as a medium temperature load, uses the refrigerant to cool a first space in step 415. In step 420, the system determines whether it is in a first mode of operation. In some embodiments, the system may make that determination based on a level of collected oil within an oil separator.

If the system is in the first mode of operation, an oil separator separates an oil from the refrigerant in step 425. In step 430, the oil separator directs the refrigerant to an ejector. The ejector directs the refrigerant to a flash tank in step 435. In step 440, the flash tank directs the (vapor) refrigerant to a first compressor, such as a medium temperature compressor. That compressor then compresses the refrigerant in step 445.

If the system should be in a second mode of operation, the oil separator directs the oil to the first compressor in step 450. In this manner, oil is separated from a refrigerant from a load and directed to a compressor, which prevents the oil from cycling in the system.

Modifications, additions, or omissions may be made to method 400 depicted in FIG. 4. Method 400 may include more, fewer, or other steps. For example, steps may be performed in parallel or in any suitable order. While discussed as systems 200 and 300 (or components thereof) performing the steps, any suitable component of systems 200 and 300 may perform one or more steps of the method.

Modifications, additions, or omissions may be made to the systems and apparatuses described herein without departing from the scope of the disclosure. The components of the systems and apparatuses may be integrated or separated. Moreover, the operations of the systems and apparatuses may be performed by more, fewer, or other components. Additionally, operations of the systems and apparatuses may be performed using any suitable logic comprising software, hardware, and/or other logic. As used in this document, "each" refers to each member of a set or each member of a subset of a set.

This disclosure may refer to a refrigerant being from a particular component of a system (e.g., the refrigerant from the medium temperature compressor, the refrigerant from the low temperature compressor, the refrigerant from the flash tank, etc.). When such terminology is used, this disclosure is not limiting the described refrigerant to being directly from the particular component. This disclosure contemplates refrigerant being from a particular component (e.g., the high side heat exchanger, medium temperature load) even though there may be other intervening components between the particular component and the destination of the refrigerant. For example, the medium temperature compressor receives a refrigerant from the medium temperature load even though there is an oil separator, flash tank, and/or medium temperature suction header between the medium temperature load and the medium temperature compressor.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. An apparatus comprising:

a high side heat exchanger configured to remove heat from a refrigerant;

a flash tank configured to store the refrigerant from the high side heat exchanger;

a first load configured to use the refrigerant from the flash tank to cool a first space proximate the first load;

a first oil separator;

a first valve disposed between the first oil separator and an ejector;

a second valve disposed between the first oil separator and the high side heat exchanger; and a first compressor;

during a first mode of operation, wherein the first valve is open and the second valve is closed:

the first oil separator configured to:

separate an oil from the refrigerant from the first load;

direct the refrigerant to the ejector, the ejector configured to direct the refrigerant from the high side heat exchanger and the refrigerant from the first oil separator to the flash tank;

the flash tank configured to direct the refrigerant from the first oil separator to the first compressor; and the first compressor configured to compress the refrigerant from the flash tank; and during a second mode of operation, wherein the first valve is closed and the second valve is open, the second valve is configured to direct refrigerant to the high side heat exchanger, and the first oil separator is configured to direct the oil separated from the refrigerant to the first compressor, wherein the oil separated from the refrigerant is directed to the first compressor due to an increase in pressure from opening the second valve.

2. The apparatus of claim 1, wherein the first oil separator is configured to direct the oil separated from the refrigerant to a suction header during the second mode of operation, the suction header configured to direct the oil to the first compressor.

3. The apparatus of claim 1, wherein the first oil separator is configured to direct the oil separated from the refrigerant to an oil reservoir during the second mode of operation, the oil reservoir configured to direct the oil to the first compressor.

4. The apparatus of claim 3, further comprising a second oil separator configured to separate the oil from the refrigerant discharged from the first compressor and to direct the oil separated from the refrigerant from the first compressor to the oil reservoir.

5. The apparatus of claim 1, further comprising a second oil separator configured to separate the oil from the refrigerant discharged from the first compressor.

6. The apparatus of claim 1, further comprising:

a second load configured to use the refrigerant from the flash tank to cool a second space proximate the second load; and a second compressor configured to compress the refrigerant from the second load, the first compressor further configured to compress the refrigerant from the second compressor.

7. The apparatus of claim 1, further comprising a third valve configured to prevent the oil separated from the refrigerant from flowing to the first oil separator during the second mode of operation.

8. A method comprising:

removing, by a high side heat exchanger, heat from a refrigerant;

storing, by a flash tank, the refrigerant from the high side heat exchanger;

using, by a first load, the refrigerant from the flash tank to cool a first space proximate the first load;

during a first mode of operation:

separating, by an oil separator, an oil from the refrigerant from the first load;

directing, by the oil separator, the refrigerant to an ejector;

directing, by the ejector, the refrigerant from the high side heat exchanger and the refrigerant from the first oil separator to the flash tank;

directing, by the flash tank, the refrigerant from the first oil separator to a first compressor; and compressing, by the first compressor, the refrigerant from the flash tank; and during a second mode of operation, directing, by the first oil separator, the oil separated from the refrigerant to the first compressor, wherein a first valve disposed between the first oil separator and the ejector is closed, wherein a second valve disposed between the first oil separator and the high side heat exchanger is open wherein the second valve is configured to direct refrigerant to the high side heat exchanger, and wherein the oil separated from the refrigerant is directed to the first compressor due to an increase in pressure from opening the second valve.

9. The method of claim 8, further comprising:

directing, by the first oil separator, the oil separated from the refrigerant to a suction header during the second mode of operation; and directing, by the suction header, the oil to the first compressor.

10. The method of claim 8, further comprising:

directing, by the first oil separator, the oil separated from the refrigerant to an oil reservoir during the second mode of operation; and directing, by the oil reservoir, the oil to the first compressor.

11. The method of claim 10, further comprising:

separating, by a second oil separator, the oil from the refrigerant discharged from the first compressor; and directing, by the second oil separator, the oil separated from the refrigerant from the first compressor to the oil reservoir.

12. The method of claim 8, further comprising separating, by a second oil separator, the oil from the refrigerant discharged from the first compressor.

13. The method of claim 8, further comprising:

using, by a second load, the refrigerant from the flash tank to cool a second space proximate the second load;

compressing, by a second compressor, the refrigerant from the second load; and compressing, by the first compressor, the refrigerant from the second compressor.

14. The method of claim 8, further comprising preventing, by a third valve, the oil separated from the refrigerant from flowing to the first oil separator during the second mode of operation.

15. A system comprising:

a high side heat exchanger configured to remove heat from a refrigerant;

a flash tank configured to store the refrigerant from the high side heat exchanger;

a first load configured to use the refrigerant from the flash tank to cool a first space proximate the first load;

a second load configured to use the refrigerant from the flash tank to cool a second space proximate the second load;

a first oil separator;

a first valve disposed between the first oil separator and an ejector;

a second valve disposed between the first oil separator and the high side heat exchanger;

a first compressor; and a second compressor configured to compress the refrigerant from the second load;

during a first mode of operation, wherein the first valve is open and the second valve is closed:

the first oil separator configured to:

separate an oil from the refrigerant from the first load;

direct the refrigerant to the ejector, the ejector configured to direct the refrigerant from the high side heat exchanger and the refrigerant from the first oil separator to the flash tank;

the flash tank configured to direct the refrigerant from the first oil separator to the first compressor; and the first compressor configured to compress the refrigerant from the flash tank and the refrigerant from the second compressor; and during a second mode of operation, wherein the first valve is closed and the second valve is open, the second valve is configured to direct refrigerant to the high side heat exchanger, and the first oil separator is configured to direct the oil separated from the refrigerant to the first compressor, wherein the oil separated from the refrigerant is directed to the first compressor due to an increase in pressure from opening the second valve.

16. The system of claim 15, wherein the first oil separator is configured to direct the oil separated from the refrigerant to a suction header during the second mode of operation, the suction header configured to direct the oil to the first compressor.

17. The system of claim 15, wherein the first oil separator is configured to direct the oil separated from the refrigerant to an oil reservoir during the second mode of operation, the oil reservoir configured to direct the refrigerant to the first compressor.

18. The system of claim 17, further comprising a second oil separator configured to separate the oil from the refrigerant discharged from the first compressor and to direct the oil separated from the refrigerant from the first compressor to the oil reservoir.

19. The system of claim 15, further comprising a second oil separator configured to separate the oil from the refrigerant discharged from the first compressor.

20. The system of claim 15, further comprising a third valve configured to prevent the oil separated from the refrigerant from flowing to the first oil separator during the second mode of operation.

* * * * *